United States Patent [19]

Silver, Jr. et al.

[11] 4,116,356

[45] Sep. 26, 1978

[54] FLOATING TANK ROOF IMPROVEMENT

[75] Inventors: Hayden J. Silver, Jr., Poughkeepsie; James H. Stackhouse, Jr., Hopewell Junction, both of N.Y.

[73] Assignee: Texaco Inc., New York, N.Y.

[21] Appl. No.: 805,258

[22] Filed: Jun. 10, 1977

[51] Int. Cl.[2] ..... B65D 25/00; B65D 87/18

[52] U.S. Cl. ..... 220/85 R; 220/216

[58] Field of Search ..... 220/85 R, 216, 217, 220/218, 219, 220, 221, 222, 223, 224, 225, 226, 227, 66, 73, 90

[56] References Cited

U.S. PATENT DOCUMENTS

| | | | |
|---|---|---|---|
| 1,611,440 | 12/1926 | Haupt | 220/216 |
| 1,714,207 | 5/1929 | Bohnhardt | 220/218 |
| 3,106,310 | 10/1963 | Scherer | 220/222 |
| 3,589,549 | 6/1971 | Heisterberg | 220/222 |

*Primary Examiner*—William Price
*Assistant Examiner*—Steven M. Pollard
*Attorney, Agent, or Firm*—Thomas H. Whaley; Carl G. Ries; Henry C. Dearborn

[57] ABSTRACT

Structure mounted at the top edge of an open top tank having a floating roof covering the fluid contents. It is an airfoil that extends above the edge, and directs air flow due to wind, down onto the windward side of the roof to equalize the otherwise uneven pressure caused by wind that increases the undesirable vapor emissions from the contents of the tank and could tend to tip the roof.

7 Claims, 6 Drawing Figures

FLOATING TANK ROOF IMPROVEMENT

BACKGROUND OF THE INVENTION

1. Field of the Invention

This invention concerns air quality control in general, and more specifically deals with structure for use on open topped floating roof tanks. Such structure is applied in order to reduce or minimize the leakage of vapors from liquid hydrocarbons stored in such tanks.

2. Description of the Prior Art

Recent studies have shown that the gaps between the floating roof seal and the inner perimeter of the sheel of a storage tank containing hydrocarbon products, are a major source of undesirable emissions. Such gaps exist because of tank settling, wind load on the shell, rivet heads, seal deterioration, and could be accentuated by any tipping of the roof created or caused by wind.

Wind blowing across the top of a floating roof tank creates a negative pressure region on the leeward side of the shell i.e. inside the open top and above the roof. At the same time, a positive pressure region is created on the other side, i.e. above the roof and below the open top of the tank. The resulting pressure differential causes air-flow into and hydrocarbon vapor flow out of the space below the roof. Such hydrocarbon vapors tend to escape into the atmosphere through any gaps which may exist around the perimeter of the roof.

Consequently, it is an object of this invention to minimize the above indicated losses by reducing or eliminating the pressure differential indicated.

While, heretofore there have been structures applied to floating tank roof-type storage tanks, which have been designated as "wind girders", these have not been effective to change the above indicated conditions that create a pressure differential on the floating roof structure. Such wind girders have been shown in prior U.S. Patents, e.g. Numbers 3,106,310 and 3,589,549.

SUMMARY OF THE INVENTION

Briefly, the invention is in combination with a large open top tank having a floating type roof covering the fluid contained therein. I concerns means for equalizing air pressure differentials on the edges of said roof caused by wind across said open top. In that combination, it comprises means for diverting said wind downward on to said roof along the windward edge of said open top.

Again briefly, the invention is in combination with a large open top tank having a floating type roof covering the fluid contained therein. It concerns means for equalizing air pressure differentials on the edges of said roof, caused by wind across said open top. It comprises an annular airfoil strip having streamlined cross-section and downwardly curved chord. Said strip is mounted with the leading edge above said tank top, and the trailing edge located radially inward relative to said tank. It also comprises an adjustable flap incorporated at said trailing edge of said strip.

BRIEF DESCRIPTION OF THE DRAWINGS

The foregoing and other objects and benefits of the invention will be more fully set forth below in connection with the best mode contemplated by the inventors of carrying out the invention, and in connection with which there are illustrations provided in the drawings, wherein.

DESCRIPTION OF THE PREFERRED EMBODIMENTS

As indicated above, the invention concerns the control of hydrocarbon emissions from storage tanks of the type having floating roofs, which cover the product therein.

Figure 1:
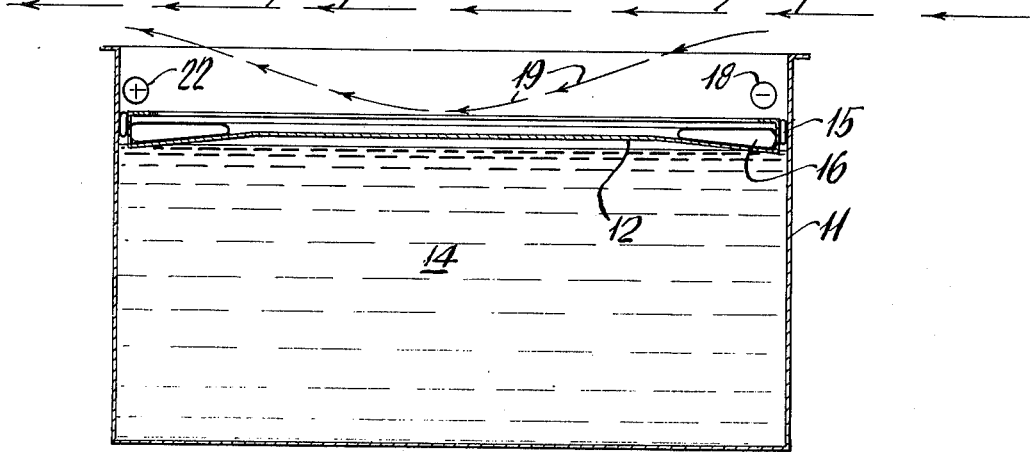
FIG. 1 is a schematic diametral cross-sectional view of a floating roof type tank, indicating wind flow currents.

FIG. 1 is a schematic illustration which shows the conditions that create emission losses, as previously indicated. Thus, there is a tank 11 that has an open top 13, as illustrated. It makes use of a floating type roof 12 that floats on the products 14 Which is inside the tank 11. The arrangement includes an annular seal 15 that is ordinarily a flexible material structure which may be hollow (as illustrated), and is attached to the roof 12 for maintaining contact with the inside surface of the walls of the tank 11. There are a plurality of pontoons 16 around the periphery of the roof 12 to provide buoyancy. It will be understood that the tank 11 might take some other geometric shape than round without changing the principles of the invention. And, of course, the roof 12 might take various other forms including the type of seal used, without changing the principles of the invention.

As indicated above, when wind blows across the tank 11 it creates a low pressure zone 18 on the inside of the windward edge of the open top 13 of tank 11. The airflow of wind across the tank 11 is indicated by flow lines arrows 19 shown in FIG. 1. On the downwind side of the roof 12 and within the tank 11 the airflow caused by the wind, tends to create a positive or higher pressure zone 22 which is schematically indicated. Consequently, there is a differential pressure created, which could tend to tip the roof 12. Furthermore, even if it does not actually open a gap at the edges adjacent to the zones 18 and 22, it at least creates the indicated pressure differential which tends to cause airflow into and air-hydrocarbon vapor flow out of the space below the roof and underneath the seal 15.

FIGS. 2–6 illustrate various modifications of the means for equalizing air pressure differentials caused by wind blowing across the open top of a tank.

Figure 2:
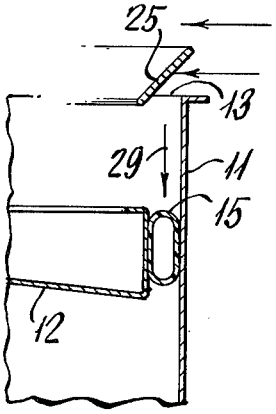
FIG. 2 is a fragmentary cross-sectional schematic, somewhat enlarged, showing one modification of a wind diverter structure according to the invention.

FIG. 2 illustrates probably the simplest arrangement. There is a flat planar strip 25, that is of course annular if the tank 11 is circular in shape. In any event, the strip 25 will be mounted by any feasible brackets or other such structure (not shown) so that it follows the contours of the open top 13. This will divert the airflow directly downward,as indicated by the arrow 29, so that the low pressure zone 18 (indicated in FIG. 1) will be eliminated.

Figure 3:
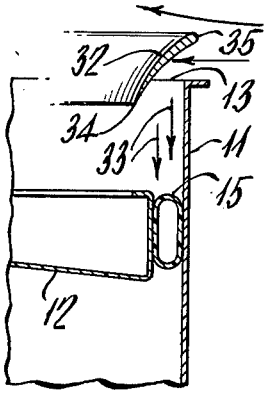
FIG. 3 is another fragmentary, somewhat enlarged, schematic cross-sectional view, illustrating another modification of an airfoil diverter according to the invention.

FIG. 3 shows another embodiment. In this case the diverting strip is made in the form of a streamlined in cross-section airfoil 32. It will direct the airflow downward, as indicated by arrows 33, so as to equalize the pressure on the roof 12. In this case, similarly as in the FIG. 2 modification, the strip 32 is mounted with its trailing edge 34 located radially inward from the walls of the tank 11. Also, there is a leading edge 35 that is above the open top 13. Again, of course the structure (not shown) for mounting the strip 32 may take any feasible form.

Figure 4:
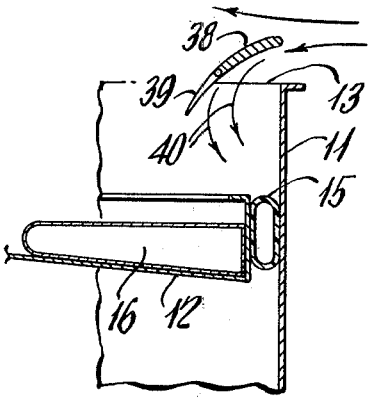
FIG. 4 is still another fragmentary cross sectional schematic illustration, showing a third embodiment of an airfoil structure according to the invention.

FIG. 4 illustrates a modification similar to FIG. 3 but with the addition of a flap 39 for providing additional control of the airflow under varying wind conditions. Thus, there is an airfoil strip 38 that incorporates the adjustable flap 39 at the trailing edge thereof. It may be noted that both of the modifications illustrated by FIGS. 3 and 4 employ a strip that is streamlined in cross-section and also is constructed with a downwardly curved chord. Thi creates conditions so that the airflow direction is smoothly changed downward. In FIG. 4, this is indicated by arrows 40.

Figure 5:
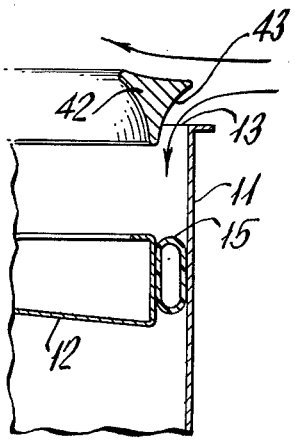
FIG. 5 is again a fragmentary, somewhat enlarged, schematic cross-sectional view illustrating a fourth embodiment of an airfoil according to the invention.

FIG. 5 illustrates another modification of the form that an airfoil strip may take. In this case there is a polygonal cross-section strip 42 that has a downward sloping concave surface 43 on the side facing outward relative to the tank 11.

Figure 6:
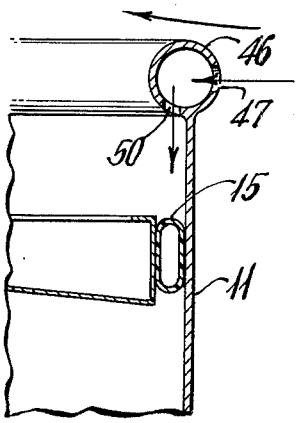
FIG. 6 is still another fragmentary, somewhat enlarged, schematic cross-sectional view illustrating a fifth embodiment of an airfoil structure according to the invention.

FIG. 6 illustrates yet another embodiment of an airfoil structure that may be employed. In this case, there is a slotted tube 46 which has a wind inlet opening 47 located along the radially outer surface of the tube 46. Also there is a downwardly directed opening or series of openings 50 that are located radially inside of the walls of the tank 11. It will be appreciated that the tube 46 may be attached to the tank 11 in any feasible manner, e.g. by being made integral with the top edge as is illustrated in FIG. 6.

It will be appreciated by any one skilled in the art that the various modifications of the airfoil structure which are indicated by the illustrations of FIGS. 2–6 will be mounted in any feasible manner (not shown). The mountings will be such that the airfoils will be held in the relative positions indicated by the illustrations. In each case the trailing edge of the airfoil is located radially inward relative to the open top 13 of the tank 11. Also, the leading edge is located above the top edge 13 of the tank.

It will be clear that while some of the modifications may be more or less effective than others, they each may be considered on the basis of cost and perhaps effectiveness under different conditions.

While particular embodiments of the invention have been described above in considerable details, in accordance with the applicable statutes, this is not to be taken as in any way limiting the invention but merely as being descriptive thereof.

We claim:

1. In combination with a large open top tank having a floating type roof covering the fluid contained therein, means for equalizing air pressure differentials on the edges of said roof caused by wind across said open top, comprising an annular airfoil strip for diverting said wind downward onto said roof along the windward edge of said open top, said annular airfoil strip comprising a downward sloping surface having a trailing edge extending radially inward a limited amount relative to said tank open top.

2. The invention according to claim 1 wherein said airfoil also comprises a flat planar strip mounted with the leading edge above said tank open top.

3. The invention according to claim 1, wherein said airfoil also comprises a strip having a streamlined cross section mounted with the leading edge above said tank open top and having a downward curved chord.

4. The invention according to claim 3, wherein said airfoil additionally comprises an adjustable flap at the trailing edge of said strip.

5. The invention according to claim 1, wherein said airfoil also comprises a strip having a polygonal cross section mounted with the leading edge above said tank top, and said downward sloping surface being concave.

6. The invention according to claim 1, wherein said airfoil also comprises a tube mounted on the top edge of said tank open top, and said tube having a wind inlet opening along the radially outer surface and a downwardly directed opening radially inside of said tank walls.

7. In combination with a large open top tank having a floating type roof covering the fluid contained therein, means for equalizing air pressure differentials on the edges of said roof caused by wind across said open top, comprising an annular airfoil strip having a streamlined cross-section and a downwardly curved chord, said strip being mounted with the leading edge above said tank open top and the trailing edge located radially inward relative to said tank, and an adjustable flap incorporated at said trailing edge of said strip.

* * * * *